United States Patent [19]

Cawrey

[11] Patent Number: 4,714,221

[45] Date of Patent: Dec. 22, 1987

[54] PEGBOARD BRACKET RETAINER

[76] Inventor: Philip G. Cawrey, 1573 Alvamar Dr., Lawrence, Kans. 66046

[21] Appl. No.: 18,424

[22] Filed: Feb. 25, 1987

[51] Int. Cl.[4] ..... A47B 96/06

[52] U.S. Cl. ..... 248/221.1; 248/220.3

[58] Field of Search ..... 248/220.3, 220.4, 221.1, 248/221.2; 211/59.1

[56] References Cited

U.S. PATENT DOCUMENTS

| | | | |
|---|---|---|---|
| 2,841,353 | 7/1958 | Burdick | 248/220.3 |
| 2,859,008 | 11/1958 | Zimmer | 248/223 |
| 2,957,671 | 10/1960 | Messier | 248/223 |
| 2,961,724 | 11/1960 | Alling | 24/73 |
| 2,987,286 | 6/1961 | Alling | 248/220.3 |
| 3,037,732 | 6/1962 | Roman | 248/223 |
| 3,069,122 | 12/1962 | Babajoff | 248/221.2 |
| 3,241,799 | 3/1966 | Terlinde | 248/221.2 |
| 3,272,468 | 9/1966 | Wittrock | 248/225 |
| 3,392,949 | 7/1968 | Meyer, Jr. | 248/220.5 |
| 3,477,677 | 11/1969 | Hindley | 248/220.3 |
| 4,452,360 | 6/1984 | Barnes | 248/220.4 X |

*Primary Examiner*—J. Franklin Foss

*Attorney, Agent, or Firm*—Beaman & Beaman

[57] ABSTRACT

A retainer for pegboard brackets for holding the brackets on the board and providing additional support and retention. The retainer includes a rear member interposed between a bracket stem located adjacent the pegboard front surface having a recess for receiving the stem and a stabilizing projection received within a pegboard perforation, and a front member extends across the bracket stem slidably attached to the rear member firmly relating the stem to the rear and front members. Latching structure defined on the front member cooperates with locking means formed on the rear member to maintain the assembly of the members.

14 Claims, 9 Drawing Figures

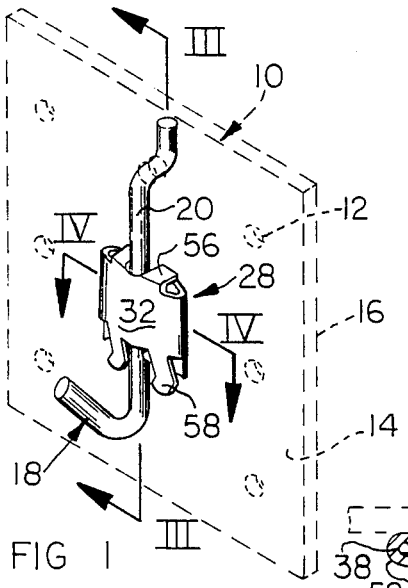
FIG 1
FIG 2
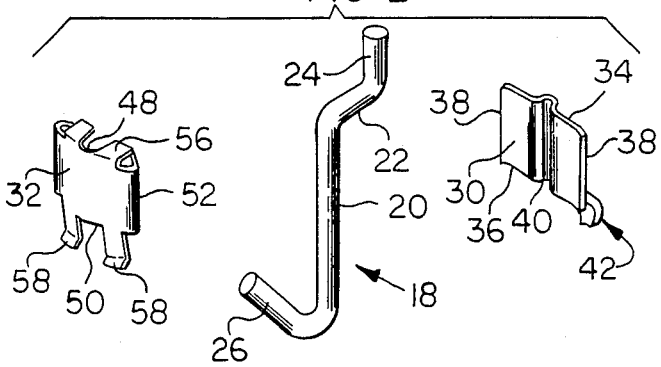
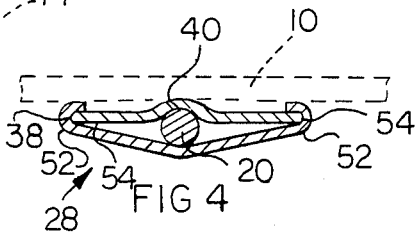
FIG 4
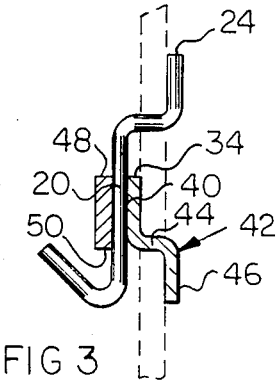
FIG 3
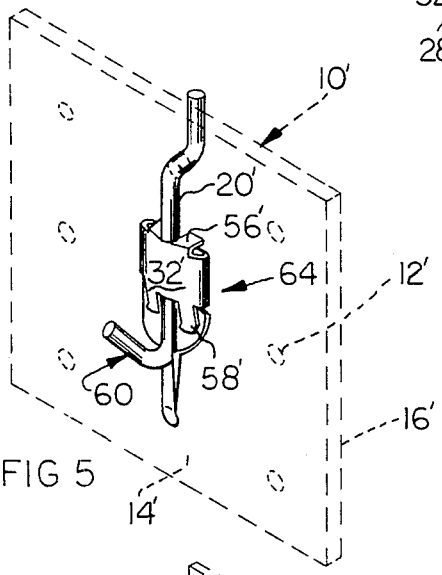
FIG 5
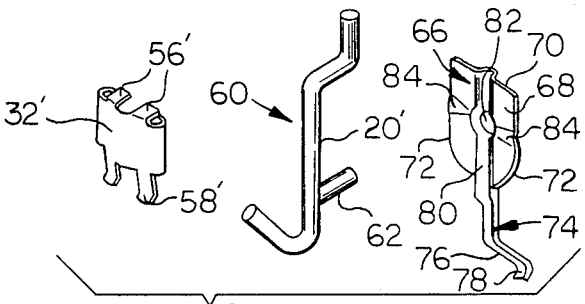
FIG 6
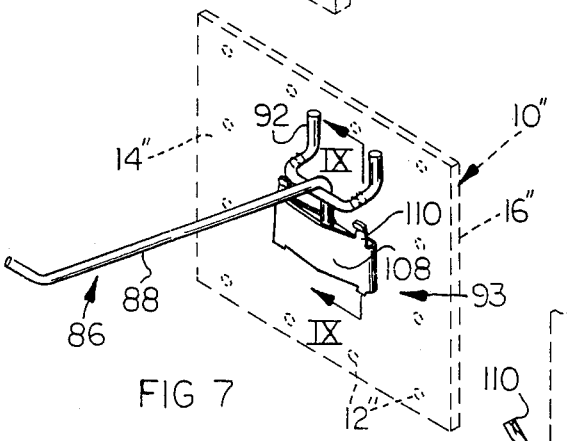
FIG 7
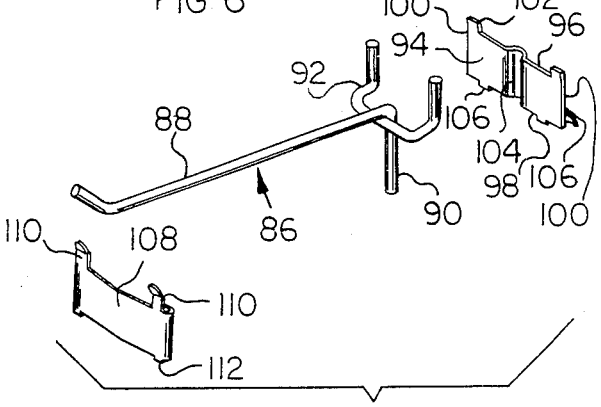
FIG 8
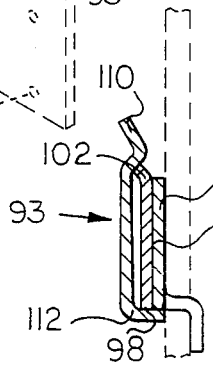
FIG 9

PEGBOARD BRACKET RETAINER

BACKGROUND OF THE INVENTION

Panels having a plurality of evenly spaced perforations defined thereon for the purpose of mounting brackets or pictures on the panel are commonly called "pegboards". Such panels with brackets and pictures mounted thereon have found wide usage in the storage and display arts.

A wide variety of brackets and hooks are available for use with pegboard. Such brackets are usually formed of a wire or rod of a diameter slightly less than that of the board perforations and the brackets are provided with at least one off-set end portion for insertion into a perforation such that the rear surface of the board is engaged and a bracket stem portion engages the board front surface. The simplest brackets or fixtures constitute hooks which suspend from a perforation and more complex brackets may use a pair of perforation inserted portions and separate stud portions for inserting into other perforations to improve stability. Commonly, most pegboard brackets and fixtures are held in position by gravity in that the bracket is tilted upwardly to permit the offset end to be inserted into a perforation or perforations and when the bracket is pivoted downwardly to its operative position the bracket will be locked to the board and may not be removed therefrom without an upward pivotal movement.

While conventional pegboard brackets are adequately locked to the pegboard panel, the bracket is loosely oriented and maintained relative to the panel and as tools or articles supported by the brackets are removed therefrom, the bracket may be inadvertently raised sufficiently to permit it to be released from the associated panel perfroations and require replacement on the panel. Also, brackets connected to the pegboard panel through only a single perforation are free to swing laterally, which often creates difficulty in placing items on such a hook.

Pegboard bracket retainers or stabilizers for overcoming the above problems have been proposed and typical examples of proposed solutions are shown in U.S. Pat. Nos. 2,859,008; 2,957,671; 2,961,724; 3,037,732; 3,272,468 and 3,392,949. While most devices shown in the aforementioned patents improve the retension and stability of pegboard brackets, such devices often require special machining or second operations on the brackets, or are of such construction as to be unsightly, expensive, or difficult to assemble to the bracket.

It is an object of the invention to provide a retainer for perforated board brackets which is economical to manufacture, requires no modification tot he bracket, and may be installed upon the bracket with ordinary skills.

Another object of the invention is to provide a perforated board bracket consisting of two sheet metal members which may be readily interconnected and mounted upon the bracket and perforated board, and will maintain their assembly during use.

Yet another object of the invention is to provide a perforated bvoard bracket retainer which may be readily formed of sheet material and may be easily assembled or removed from the associated bracket, and does not interfere with normal bracket use.

In the practice of the invention the pegboard bracket retainer consists of two members which may be readily formed of sheet metal, but could be of synthetic plastic material. A rear member is located between a bracket stem and the perforated panel front surface and includes end regions and lateral edges. A recess is defined in the rear member snugly receiving the bracket stem, and a stabilizing projection defined on the rear member extends through at least one of the panel perforations to lock the rear member to the panel.

A front member is slidably mounted upon the rear member by the use of channels defined on the front member lateral edges receiving the rear member lateral edges. As the front member engages the front portion of the bracket stem, it maintains the stem within the rear member recess and the stem is "sandwhiched" between the rear and front members.

Latching projections are defined upon the front member for cooperating with locking edges or elements formed on the rear member once the members are fully assembled, and the engagement of the latch and locking means prevents inadvertent displacement between the members. Also, stops in the form of tabs are defined on the front member for engaging an end edge of the rear member to limit the relative sliding movement of the front member on the rear member during assembly of the retainer components.

The basic concepts of the invention are readily adaptable to various forms and configurations of pegboard brackets, as disclosed in the accompanying drawings, and all versions of the invention may be economically manufactured and installed with a minimum of skills.

BRIEF DESCRIPTION OF THE DRAWINGS

The aforementioned objects and advantages of the invention will be appreciated from the following description and accompanying drawings wherein:

FIG. 1 is a perspective view of an embodiment of the retainer of the invention as used with a hook bracket illustrating a portion of perforated panel and the retainer fully assembled, FIG. 2 is a perspective exploded view of the bracket and retainer members of the embodiment of FIG. 1, FIG. 3 is an elevational, sectional view as taken through Section III—III of FIG. 1, FIG. 4 is a plan, sectional view as taken through Section IV—IV of FIG. 1, FIG. 5 is a perspective view of another embodiment of bracket and retainer illustrating the fully assembled relationship and a portion of a perforated panel, FIG. 6 is an exploded perspective view of the bracket and retainer of FIG. 5, FIG. 7 is a perspective view of another embodiment of the retainer of the invention as used with another type of bracket, the panel being illustrated in dotted lines, FIG. 8 is a perspective exploded view of the retainer and bracket shown in FIG. 7, and FIG. 9 is an elevational, section view as taken along Section IX—IX of FIG. 7.

DESCRIPTION OF THE PREFERRED EMBODIMENT

As shown in FIGS. 1, 5 and 7 the retainers using the concepts of the invention are used with brackets mounted upon conventional perforated panels 10, commonly called "pegboard", which are shown in dotted lines. Such panels are usually formed of pressed paper or the like and include a plurality of cylindrical perforations 12 intersecting the panel front surface 14 and rear surface 16 and are spaced from each other in a standard modular manner wherein the perforations form vertical columns and horizontal rows.

A typical hook-type bracket used with pegboard panel is shown at 18 in FIGS. 1 and 2. The bracket consists of wire of a diameter slightly less than that of the perforations 12 and the hook configuration includes a linear stem 20, a right-angled offset portion 22, and an offset end portion 24 substantially parallel to the stem 20. The length of the portion 22 is such that the portion will extend through the panel so that the stem 20 will be disposed adjacent the panel front surface 14, and the end portion 24 will be located adjacent the panel rear surface 16, FIG. 3. At its lower end the stem is provided with an upstanding hook portion 26 for receiving the article to be supported, not shown.

As is well known, the bracket 18 is mounted upon the panel 10 by raising the stem 20 to a horizontal orientation, inserting the end portion 24 into the desired perforation 12, and permitting the stem to pivot downwardly, which will locate the portion 22 within the perforation so that the stem 20 will suspend below the associated perforation adjacent the panel surface 14.

The bracket retainer 28 shown in FIGS. 1–4 includes a rear member 30, and a front member 32. The members 30 and 32 are formed of a sheet material and may be stamped of steel or other metal, or may be molded or otherwise formed of a synthetic plastic material.

The rear member 30 is of a generally planar configuration having an upper end edge 34, a lower end edge 36, and parallel lateral edges 38 extend between the end edges. At its central region the rear member includes a recess 40 which forms an elongated semi-cylindrical cradle of a diameter substantially equal to the diameter of the bracket stem 20. At its lower edge 36 the member 30 is formed with a central stabilizer projection 42 of the material of the rear member and the projection includes a substantially horizontal portion 44 for extending through a perforation 12 below the perforation through which the bracket portion 22 extends, and the projection 44 also includes the downwardly extending portion 46 for engaging the panel rear surface 16.

The front member 32 is of a convex-concave configuration having an upper end edge 48 and a lower end edge 50. The lateral edges of the front member include inwardly turned flanges 52 wherein a V-shaped channel guide 54 is defined at each lateral edge. The channels 54 are parallel to each other and spaced apart in opposed relationship by a dimension substantially corresponding to the spacing between the rear member edges 38 wherein the front member 32 may be slidingly connected to the rear member 30, as later described.

The front member 32 includes a pair of projections or tabs 56 extending from the upper end edge 50 toward the flanges 52 and at its lower edge a pair of latching projections or tabs 58 are formed whose ends are slightly deformed outwardly as will be appreciated from the drawings.

Use of the retainer 28 is achieved by inserting the stabilizing projection 42 in the perforation 12 of the panel 10 immediately below the perforation 12 which receives the bracket 18 upper end. By pivoting the rear member 30 substantially horizontal, the stabilizer projection 42 may be inserted into the intended perforation and the rear member pivoted upwardly to produce the relationship shown in FIGS. 1 and 3. The bracket 18 may then be inserted into the perforation 12 immediately thereabove, if it has not already been installed, and the stem 20 will lie within the recess 40.

Thereupon, the front member 32 is placed over the outer portion of the stem above the rear member 30 with the channels 54 in alignment with the lateral edges 38. By pushing the front member downwardly the primary portion of the front member 32 will be brought into alignment with the rear member 30 as the guide channels 54 move over the lateral edges 38. Full assembly is achieved when the stop tabs 56 engage the rear member upper edge 34, and at such time the inwardly deformed latching projections 58 will pass over the rear member lower edge 36 such that the edge functions as a lock engaging the latch projections providing a firm frictional resistance to upward movement of the front member 32 relative to the rear member 30.

With the members 30 and 32 so assembled the stem 20 is firmly "sandwiched" between the members and the configuration of the front member 32 is such as to firmly hold the bracket stem within the rear member recess 40. Also, the tabs 56 and 58 will be located upon opposite sides of the stem. In this manner the bracket stem is firmly connected to the retainer and as the retainer 28 is affixed to the panel through stabilizer projection 42, the bracket 18 is, in effect, connected to the panel at two locations and displacement of the bracket is prevented.

As will be appreciated from FIG. 1, the size of the retainer 28 with respect to the bracket 18 does not limit the use of the hook bracket for its intended purposes, and no modification has been required to the bracket to provide the advantages achieved with the retainer.

FIGS. 5 and 6 describe another embodiment of bracket commonly used with pegboard panels, and components similar to those previously described are designated by primed reference numerals.

In FIGS. 5 and 6 the bracket 60 is also of the suspended hook type. However, an additional stud 62 has been welded upon the stem 20′ for reception into the perforation 12′ below the perforation supporting the bracket. The purpose of the stud 62 is to provide additional support to the bracket and prevent lateral displacement. While this type of bracket is more firmly associated with the panel 10′ than the bracket of FIGS. 1–4, it is still possible to inadvertently raise the bracket 60 upwardly and release it from the panel.

The retainer 64 of the embodiment of FIGS. 5 and 6 uses a rear member 66 which is of a generally planar configuration having a body 68 defined by an upper end edge 70 and parallel side edges 72. At its lower region the body 68 is of an arcuate configuration and the stabilizer projection 74 extends substantially below the body and includes a portion 76 for extending through the panel perforation and the projection portion 78 will engage the panel rear surface 16′.

The rear member 66 includes a central elongated vertical recess 80 for receiving the stem 20′ and a hole 82 defined in the recess permits the stud 62 to pass therethrough. Further, raised ribs 84 are formed on the rear member body adjacent the edges 72 to form a stop abutment for the front member as later described.

The front member 32′ is identical to that previously described, as indicated by the primed numbers.

To install the retainer 64 of FIGS. 5 and 6, the rear member 66 must be mounted on the panel 10′ prior to the bracket 60 being mounted thereon. The stabilizer projection 74 is inserted into the lowermost of the three perforations 12′ that will be used, and once the rear member is positioned as shown in FIG. 5, the bracket 60 may be inserted into the uppermost associated perforation 12′ and the stud 62 will extend through the hole 82 into the intermediary panel perforation. This relationship will position the stem 20′ within the recess 80.

The front member 32′ is now mounted on the rear member 66 is a manner identical to that described with respect to FIGS. 1–4. As the front member 32′ is pushed downwardly over the rear member 66 the latching projection 58′ will be deformed to ride over the rear member ribs 84, and the inwardly deformed ends of the projections 58 will engage the lowermost portion of the ribs 84 when the stop tabs 56′ engage the rear member edge 70. Thus, it will be appreciated that the retainer 66 shown in FIGS. 5 and 6 will prevent the bracket 60 from being lifted and inadvertently removed from the panel 10′.

Yet another embodiment is shown in FIGS. 7–9. In this embodiment components identical to those previously described are indicated by double primed reference numerals.

The bracket 86 shown in FIGS. 7–9 includes an elongated horizontally extending portion 88 which is used to support a plurality of articles mounted thereon, not shown, or may be used to support a shelf, not shown. The bracket includes a downwardly extending stem 90, and an element 92 is welded to the portion 88 adjacent the stem including offset portions which extend through two of the perforations 12′ and engage the panel rear surface 16″.

The retainer 93 includes a rear member 94 having a substantially planar body having an upper end edge 96 and a lower end edge 98. The width is defined by the side edges 100, and as will be appreciated from FIG. 8, upwardly extending shoulders 102 are defined on the rear member body adjacent the edges 100 and extend beyond the upper edge 96. The shoulders 102 are deformed slightly outwardly. The rear member is provided with a recess 104 and at its lower edge 98 a pair of stabilizing projections 106 extend rearwardly therefrom for cooperation with a pair of panel perforations 12″ adjacent to each other in the same horizontal row.

The front member 108 is substantially identical in construction to the front members described relative to the previous embodiments, except that the latching tabs 110 extend upwardly, rather than downwardly, and the stop tabs 112 are defined at the lower edge of the front member.

In use, the rear member 94 is positioned upon the panel 10″ by inserting the two stabilizing projections 106 into adjacent perforations 12″ and the member 94 is pivoted upwardly against the panel. The bracket 86 is then mounted in the panel by inserting the element 92 into the perforations 12″ immediately above those occupied by the stabilizing projections. Such assembly will locate the stem 90 within the recess 104. The front member 108 is then located below the rear member 94 and moved upwardly to "sandwich" the stem 90 between the rear and front members. As the front member is moved upwardly, the latch tabs 110 will ride over the shoulders 102 and upon the locking tabs 112 engaging the lower edge 98 of the rear member, the tabs 110 will be related to the shoulders 102 as shown in FIG. 9 producing a locking of the front member 108 on the rear member 94 preventing the front member from inadvertently disengaging from the rear member.

It will be appreciated that the retainer 93 will firmly support the bracket stem 90 and prevent the bracket portion 88 from being inadvertently lifted, as is a common occurrence with this type of pegboard bracket.

From the above description it will be appreciated that the objects and advantages of the invention have been achieved by the disclosed retainers, and it is understood that various modifications to the inventive concepts may be apparent to those skilled in the art without departing from the spirit and scope of the invention.

I claim:

1. A retainer for perforated board brackets wherein the board includes front and rear surfaces intersected by perforations and the bracket includes an elongated stem located adjacent the board surface, comprising, in combination, a rear member adapted to be inserted between the bracket stem and the board front surface, said rear member including lateral edges and first and second end regions, a front member having lateral sides defining a horizontal width as great as the width of said rear member and first and second end regions, guides defined upon said front member lateral sides mating with said rear member lateral edges whereby said front and rear members may be interconnected with the bracket stem located therebetween, stem locating means defined upon one of said members, and a stabilizer projection defined upon one of said rear member end regions for reception into a board perforation.

2. A retainer for perforated board brackets as in claim 1 wherein guides comprise channels defined upon said front member lateral sides, rear member lateral edge being slidably received within a front member channel.

3. In a retainer for perforated board brackets wherein the board includes front and rear surfaces intersected by perforations and the bracket includes an elongated stem located adjacent the board front surface, comprising, in combination, a rear member adapted to be inserted between the bracket stem and the board front surface, said rear member including lateral edges and first and second end regions, a front member having lateral sides and first and second end regions, guides defined upon said front member lateral sides mating with said rear member lateral edges whereby said front and rear members may be interconnected with the bracket stem located therebetween, stem locating means defined upon one of said members, a stabilizer projection defined upon one of said rear member end regions for reception into a board projection, said guides comprising channels defined upon said front member lateral sides, each rear member lateral edge being slidably received within a front member channel, said stem locating means comprising an elongated recess defined in said rear member adapted to receive the bracket stem.

4. In a retainer for perforated board brackets wherein the board includes front and rear surfaces intersected by perforations and the bracket includes an elongated stem located adjacent the board front surface, comprising, in combination, a rear member adapted to be inserted between the bracket stem and the board front surface, said rear member including lateral edges and first and second end regions, a front member having lateral sides and first and second end regions, guides defined upon said front member lateral sides mating with said rear member lateral edges whereby said front and rear members may be interconnected with the bracket stem located therebetween, stem locating means defined upon one of said members, a stabilizer projection defined upon one of said back member end regions for reception into a board perforation, said guides comprising channels defined upon said front member lateral sides, each rear member lateral edge being slidably received within a front member channel, a stop defined on said front member first end region engaging with said rear member first end region upon said front member being fully slidably mounted upon said rear member.

5. In a retainer for perforated board brackets as in claim 4, latch means defined on said front member second end region, and locking means defined on said rear member second end region engaged by said latch means upon said front member being fully slidably mounted upon said rear member maintaining the fully assembled relationship of said members.

6. In a retainer for perforated board brackets as in claim 4, said stop comprising a tab defined on said front member first end region.

7. In a retainer for perforated board brackets as in claim 5, said latch means comprising at least one resilient projection homogeneously defined on said front member of the material of said front member adapted to be deformed by said locking means upon engagement thereby to produce a frictional interconnection between said latch and locking means.

8. In a retainer for perforated board brackets as in claim 2, said stabilizer projection being homogeneously formed of the material of said rear member.

9. In a retainer for perforated board brackets as in claim 2, said rear and front members being formed of sheet material.

10. A retainer for perforated board brackets wherein the board includes front and rear surfaces intersected by perforations and the bracket includes an elongated stem located adjacent the board front surface, comprising, in combination, a rear member of generally planar configuration formed of a sheet material and having first and second end regions and lateral edges adapted to be inserted between the bracket stem and the board front surface, an elongated recess defined in said rear member intersecting said end regions and adapted to receive the bracket stem, a front member of a slightly concave-convex configuration formed of sheet material and having first and second end regions and lateral sides, channels defined on said lateral sides whereby said front member may be slidably mounted upon said rear member by receiving said lateral edges within said channels and the bracket stem will be located between said front and rear members and held in said rear member recess by said front member, and a stabilizer projection defined on an end region of said rear member for reception into a board perforation and engagement with the board rear surface.

11. In a retainer for perforated board as in claim 10, a stop defined on said front member first end region engaging with said rear xember first end region upon said front member being fully slidably mounted upon said rear member.

12. In a retainer for perforated board as in claim 11, latch means defined on said front member second end region, and locking means defined on said rear member second end region engaged by said latch means upon said front member being fully slidably mounted upon said rear member maintaining the fully assembled relationship of said members.

13. In a retainer for perforated board as in claim 12, said stop comprising a tab defined on said front rember first end region.

14. In a retainer for perforated board as in claim 13, said latch means comprising at least one resilient projection homogeneously defined on said front member of the material of said front member adapted to be deformed by said locking means upon engagement thereby to produce a frictional interconnection between said latch and locking means.

* * * * *